US009156127B2

(12) United States Patent
Fukuda et al.

(10) Patent No.: US 9,156,127 B2
(45) Date of Patent: Oct. 13, 2015

(54) POLISHING PAD AND METHOD FOR PRODUCING SAME

(75) Inventors: Takeshi Fukuda, Osaka (JP); Nobuyoshi Ishizaka, Osaka (JP)

(73) Assignee: Toyo Tire & Rubber Co., Ltd., Osaka (JP)

( * ) Notice: Subject to any disclaimer, the term of this patent is extended or adjusted under 35 U.S.C. 154(b) by 216 days.

(21) Appl. No.: 13/141,298

(22) PCT Filed: Dec. 24, 2009

(86) PCT No.: PCT/JP2009/071480

§ 371 (c)(1),
(2), (4) Date: Jun. 21, 2011

(87) PCT Pub. No.: WO2010/074168

PCT Pub. Date: Jul. 1, 2010

(65) Prior Publication Data

US 2011/0256817 A1 Oct. 20, 2011

(30) Foreign Application Priority Data

Dec. 26, 2008 (JP) ..... 2008-332720

(51) Int. Cl.

| | |
|---|---|
| ***B32B 3/00*** | (2006.01) |
| ***B32B 3/26*** | (2006.01) |
| ***B24D 11/00*** | (2006.01) |
| ***B24B 37/24*** | (2012.01) |

(52) U.S. Cl.
CPC ..... *B24B 37/24* (2013.01); *Y10T 428/249978* (2015.04)

(58) Field of Classification Search
None
See application file for complete search history.

(56) References Cited

U.S. PATENT DOCUMENTS

| | | | |
|---|---|---|---|
| 6,454,634 | B1 | 9/2002 | James et al. |
| 6,736,709 | B1 | 5/2004 | James et al. |
| 6,749,485 | B1 | 6/2004 | James et al. |

(Continued)

FOREIGN PATENT DOCUMENTS

| | | |
|---|---|---|
| JP | 2000-345145 | 12/2000 |
| JP | 2003-37089 | 2/2003 |

(Continued)

OTHER PUBLICATIONS

Internation Search Report mailed Feb. 2, 2010, directed to International Application No. PCT/JP2009/071480; 2 pages.

(Continued)

*Primary Examiner* — Alicia Chevalier
*Assistant Examiner* — Chinessa Adkins
(74) *Attorney, Agent, or Firm* — Morrison & Foerster LLP

(57) ABSTRACT

An object of the invention is to provide a polishing pad that achieves a high polishing rate and has high thickness precision so that the break-in time (dummy polishing time) can be shortened, and to provide a method for producing same. The invention is directed to a polishing pad including a base material layer and a polishing layer provided on the base material layer, wherein the polishing layer includes a thermoset polyurethane foam having roughly spherical interconnected cells with an average cell diameter of 35 to 200 μm, and the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

7 Claims, 1 Drawing Sheet

(56) References Cited

U.S. PATENT DOCUMENTS

| | | | | |
|---|---|---|---|---|
| 6,860,802 | B1 | 3/2005 | Vishwanathan et al. | |
| 2003/0027500 | A1 | 2/2003 | James et al. | |
| 2004/0157985 | A1 | 8/2004 | Masui et al. | |
| 2004/0209554 | A1* | 10/2004 | Tsumagari et al. | 451/36 |
| 2005/0020082 | A1* | 1/2005 | Vishwanathan et al. | 438/690 |
| 2006/0060569 | A1* | 3/2006 | Tano et al. | 216/88 |
| 2006/0084365 | A1* | 4/2006 | Sakurai et al. | 451/41 |
| 2007/0180778 | A1* | 8/2007 | Prasad | 51/298 |
| 2008/0090498 | A1* | 4/2008 | Misra et al. | 451/41 |
| 2010/0048102 | A1 | 2/2010 | Nakai et al. | |

FOREIGN PATENT DOCUMENTS

| | | |
|---|---|---|
| JP | 2003-100681 | 4/2003 |
| JP | 2004-507076 | 3/2004 |
| JP | 2004-291155 | 10/2004 |
| JP | 2004-335713 | 11/2004 |
| JP | 2004-339249 | 12/2004 |
| JP | 2005-169578 | 6/2005 |
| JP | 2006-75914 | 3/2006 |
| JP | 2006-114885 | 4/2006 |
| JP | 2007-91898 | 4/2007 |
| JP | 2007-245298 | 9/2007 |
| JP | 2008-222769 | 9/2008 |
| TV | 200502051 | 1/2005 |
| TW | 574274 | 2/2004 |
| TW | 200846381 | 12/2008 |

OTHER PUBLICATIONS

Taiwanese Office Action dated Nov. 22, 2012, directed to Taiwanese Patent Application No. 098145012; 11 pages.

* cited by examiner

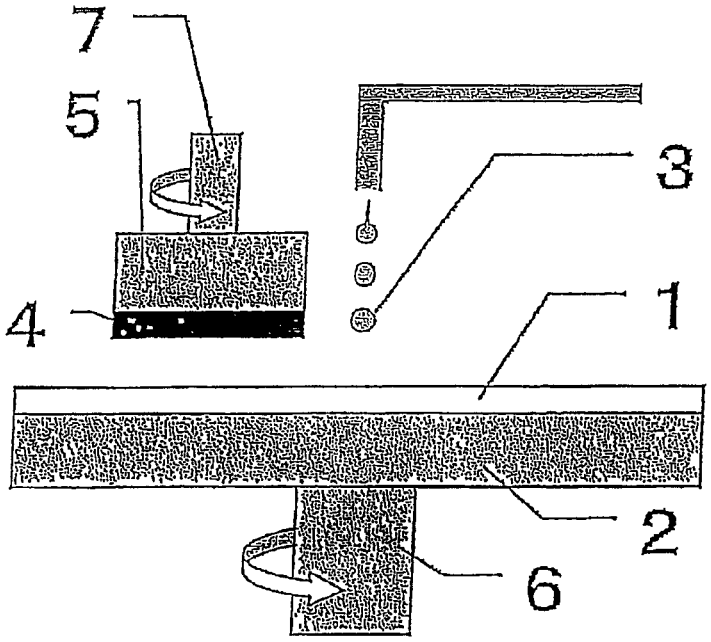
7
5
3
4
1
2
6

POLISHING PAD AND METHOD FOR PRODUCING SAME

TECHNICAL FIELD

The present invention relates to a polishing pad (for rough polishing or for final polishing), which is used upon polishing of a surface of optical materials such as lenses and reflection mirrors, a glass substrate for silicon wafers and hard disks, and an aluminum substrate. Particularly, the polishing pad of the present invention is suitably used as a polishing pad for finishing.

BACKGROUND ART

Generally, the mirror polishing of semiconductor wafers such as a silicon wafer etc., lenses, and glass substrates includes rough polishing primarily intended to regulate planarity and in-plane uniformity and final polishing primarily intended to improve surface roughness and removal of scratches.

The final polishing is carried out usually by rubbing a wafer against an artificial suede made of flexible urethane foam stuck to a rotatable platen and simultaneously feeding thereon an abrasive containing a colloidal silica in an alkali-based aqueous solution (Patent Literature 1).

As the polishing pad for finishing used in final polishing, the following polishing pads have been proposed besides those described above.

A suede finishing polishing pad comprising a nap layer having a large number of long and thin holes (naps) formed with a foaming agent in the thickness direction, in polyurethane resin, and a foundation cloth for reinforcing the nap layer is proposed (Patent Literature 2).

A suede abrasive cloth for final polishing, in which surface roughness is expressed as an arithmetic average roughness (Ra) of 5 μm or less, is proposed (Patent Literature 3).

An abrasive cloth for final polishing, which is provided with a base material part and a surface layer (nap layer) formed on the base material part, wherein a polyvinyl halide or vinyl halide copolymer is contained in the surface layer, is proposed (Patent Literature 4).

Conventional polishing pads have been produced by a wet curing method. The wet curing method is a method wherein an urethane resin solution obtained by dissolving urethane resin in a water-soluble organic solvent such as dimethylformamide is applied onto a base material, then wet-solidified by treatment in water, to form a porous grain side layer, which is then washed with water and dried, followed by polishing of the grain side layer to form a surface layer (nap layer). In Patent Literature 5, for example, an abrasive cloth for finishing, having roughly spherical holes having an average particle diameter of 1 to 30 μm, is produced by the wet curing method.

Unfortunately, conventional polishing pads have a problem in which since they have a long, thin cell structure or a surface layer made of a material with low mechanical strength, their durability is low so that the planarization performance is gradually degraded or they have low polishing rate stability. Conventional polishing pads also have a problem in which cells are often clogged with polished debris (particularly pad debris) so that they have low stability of polishing characteristics and a short life.

On the other hand, the polishing pads described below are proposed for use in rough polishing.

Patent Literature 6 discloses a polishing pad for use in polishing the surface of a semiconductor device or a precursor thereof and planarizing a metal damascene structure on a semiconductor wafer, which includes a polishing layer having a E' ratio of about 1 to 3.6 at 30° C. to 90° C., a Shore D hardness of about 40 to 70, and a tensile modulus of about 150 to 2,000 MPa at 40° C.

Patent Literature 7 discloses a mechanochemical polishing pad capable of reducing scratching of the surface of an object being polished and reducing delamination of a low-dielectric insulating film, which includes a polishing body having a storage modulus E' (30° C.) of 120 MPa or less at 30° C. and a ratio of storage modulus E' (30° C.) at 30° C. to storage modulus E' (60° C.) at 60° C. (E'(30° C.)/E'(60° C.)) of 2.5 or more.

Patent Literature 8 discloses a process for reducing appearance defects such as slicing marks in a polishing layer made of a hard polyurethane foam and reducing variations in the thickness of the polishing layer so that the flatness of the polishing surface can be improved, which includes providing a polyurethane foam block with an Asker D hardness of 50 or more at ambient temperatures, controlling the surface hardness of the polyurethane foam block within the Asker hardness range of 80 to 95, and slicing the polyurethane foam block with the controlled hardness into pieces with a predetermined thickness, so that polishing sheets are formed.

Patent Literature 1: JP-A 2003-37089
Patent Literature 2: JP-A 2003-100681
Patent Literature 3: JP-A 2004-291155
Patent Literature 4: JP-A 2004-335713
Patent Literature 5: JP-A 2006-75914
Patent Literature 6: JP-A 2004-507076
Patent Literature 7: JP-A 2006-114885
Patent Literature 8: JP-A 2005-169578

DISCLOSURE OF THE INVENTION

Problems to be Solved by the Invention

An object of the invention is to provide a polishing pad that achieves a high polishing rate and has high thickness precision so that the break-in time (dummy polishing time) can be shortened, and to provide a method for producing same.

Means for Solving the Problems

The present inventors made extensive study to solve the problem described above, and as a result, they found that the object can be achieved by the following polishing pad and reached completion of the present invention.

Specifically, the invention is directed to a polishing pad including a base material layer and a polishing layer provided on the base material layer, wherein the polishing layer includes a thermoset polyurethane foam having roughly spherical interconnected cells with an average cell diameter of 35 to 200 μm, and the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

It is considered that since conventional final polishing pads have a long, thin cell structure or a polishing layer made of a material with low mechanical strength, they "fatigue" to have low durability when pressure is repeatedly applied to the polishing layer. In contrast, when a thermoset polyurethane foam having roughly spherical interconnected cells as described above is used to form a polishing layer, the polishing layer can have improved durability. Therefore, the use of the polishing pad of the invention makes it possible to maintain high planarization performance for a long time and to improve polishing rate stability. As used herein, the term "roughly spherical" is intended to include "spherical" and "ellipsoidal." Ellipsoidal cells have a ratio (L/S) of long axis L to short axis S of 5 or less, preferably 3 or less, more preferably 1.5 or less.

If the average cell diameter of the interconnected cells is less than 35 μm, polished debris (particularly pad debris) may be deposited in the cells so that the cells may tend to fail to sufficiently play a role in holding slurry. If the average cell diameter is more than 200 μm, the polishing layer will be more likely to "fatigue" under repeated application of pressure to the polishing layer, so that the durability may be reduced, which is undesirable.

It is also necessary for the polishing layer to have a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

Usually during rough polishing or final polishing, the surface temperature of polishing layers varies within the range of about 30 to 60° C. In an embodiment of the invention, the storage modulus and storage modulus ratios of the polishing layer at the temperatures are controlled within the specified ranges, which makes it possible to increase the polishing rate at which polishing is performed with the polishing pad. If the storage modulus E' (40° C.) is less than 130 MPa, the polishing rate may be low. If it is more than 400 MPa, the object being polished may be more prone to scratching. If the ratio E'(30° C.)/E'(60° C.) is more than 2.5, the polishing rate may be low.

Generally, the process of controlling the thickness of a polishing pad (polishing layer) (slicing process) is performed at relatively high temperature under heating so that the slicing can be easily performed. In this case, the precision of the thickness of the polishing layer tends to be low. In an embodiment of the invention, the storage modulus ratios of the polishing layer are controlled within the specific ranges, so that the precision of the thickness of the polishing layer can be kept at a high level in the thickness-controlling process without heating the polishing layer at high temperature, which makes it possible to shorten the break-in time (dummy polishing time). If the ratio E'(30° C.)/E'(90° C.) is less than 15, the hardness may be high, which makes slicing difficult, so that heating the polishing layer at high temperature becomes necessary in the thickness-controlling process, and if the ratio is less than 15, the difference between the temperature during heating and the room temperature may be large, so that the precision of the thickness of the polishing layer cannot be kept at a high level. If the ratio E'(30° C.)/E'(90° C.) is more than 130, the thickness of the slice may be changed even by a slight change in temperature, which makes it impossible to keep a high level of the precision of the thickness of the polishing layer.

The thermoset polyurethane foam is preferably a product of reaction and curing of a urethane composition containing an isocyanate component and active hydrogen-containing compounds, and the active hydrogen-containing compounds preferably include 35 to 90% by weight of a trifunctional polyol with a hydroxyl value of 150 to 400 mgKOH/g and/or a tetrafunctional polyol with a hydroxyl value of 150 to 400 mgKOH/g. The active hydrogen-containing compounds preferably further include 10 to 50% by weight of a bifunctional polyol with a hydroxyl value of 30 to 150 mgKOH/g. When these materials are used, the storage modulus and storage modulus ratios of the polishing layer are successfully controlled within the specified ranges.

The polishing layer is preferably self-bonded to the base material layer. This makes it possible to effectively prevent peeling between the polishing layer and the base material layer during polishing.

The invention is also directed to a method for producing a polishing pad, including the steps of: preparing, by a mechanical foaming method, a cell dispersed urethane composition which contains an isocyanate component, active hydrogen-containing compounds including 35 to 90% by weight of a trifunctional polyol with a hydroxyl value of 150 to 400 mgKOH/g and/or a tetrafunctional polyol with a hydroxyl value of 150 to 400 mgKOH/g, and a silicone surfactant; applying the cell dispersed urethane composition to a base material layer; curing the cell dispersed urethane composition to form a thermoset polyurethane foam having roughly spherical interconnected cells with an average cell diameter of 35 to 200 μm; and uniformly controlling the thickness of the thermoset polyurethane foam to form a polishing layer, wherein the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

The invention is also directed to a method for producing a polishing pad, including the steps of: preparing, by a mechanical foaming method, a cell dispersed urethane composition which contains an isocyanate component, active hydrogen-containing compounds including 35 to 90% by weight of a trifunctional polyol with a hydroxyl value of 150 to 400 mgKOH/g and/or a tetrafunctional polyol with a hydroxyl value of 150 to 400 mgKOH/g, and a silicone surfactant; applying the cell dispersed urethane composition to a release sheet; placing a base material layer on the cell dispersed urethane composition; curing the cell dispersed urethane composition, while making a uniform thickness by pressing means, so that a thermoset polyurethane foam having roughly spherical interconnected cells with an average cell diameter of 35 to 200 μm is formed; peeling off the release sheet under the thermoset polyurethane foam; and removing a skin layer from the exposed surface of the thermoset polyurethane foam, wherein the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

BRIEF DESCRIPTION OF DRAWINGS

FIG. 1 is a schematic illustration showing one example of a conventional polishing apparatus used in CMP polishing.

BEST MODE FOR CARRYING OUT THE INVENTION

The polishing pad of the present invention comprise a base material layer and a polishing layer made of a thermosetting polyurethane foam (hereinafter referred to as polyurethane foam) having roughly spherical interconnected cells having an average cell diameter of 35 to 200 μm.

The polyurethane resin is a preferable material for forming the polishing layer because it is excellent in abrasion resistance, a polyurethane polymer having desired physical properties can be easily obtained by changing its raw material composition, and roughly spherical fine cells can be easily formed by a mechanical foaming method (including a mechanical frothing method).

The polyurethane resin comprises an isocyanate component and an active hydrogen-containing compound (high-molecular-weight polyol, low-molecular-weight polyol, low-molecular-weight polyamine and chain extender etc.).

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, polymeric MDI, carbodiimide-modified MDI (for example, Millionate MTL made by Nippon Polyurethane Industry Co., Ltd.), 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the isocyanate component, it is possible to use not only the above-described diisocyanate compounds but also multifunctional (trifunctional or more) polyisocyanates. As the multifunctional isocyanate compounds, a series of diisocyanate adduct compounds are commercially available as Desmodul-N (Bayer) and Duranate™ (Asahi Chemical Industry Co., Ltd.).

Among the isocyanate components described above, 4,4'-diphenylmethane diisocyanate or carbodiimide-modified MDI is preferably used.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, polycarbonate polyols obtained by ester exchange reaction of a polyhydroxyl compound with aryl carbonate, and polymer polyols such as polyether polyol in which polymer particles are dispersed. These may be used singly or as a mixture of two or more thereof.

The high-molecular-weight polyol preferably has a hydroxyl value of 30 to 400 mgKOH/g. The content of the high-molecular-weight polyol in all active hydrogen-containing compounds is preferably from 80 to 95% by weight, more preferably from 85 to 95% by weight. When the high-molecular-weight polyol is used in such a specific amount, foam films are more likely to be broken, so that interconnected cell structures can be easily formed.

Among the above high-molecular-weight polyols, a trifunctional polyol with a hydroxyl value of 150 to 400 mgKOH/g and/or a tetrafunctional polyol with a hydroxyl value of 150 to 400 mgKOH/g is preferably used. The trifunctional polyol and/or the tetrafunctional polyol more preferably has a hydroxyl value of 150 to 350 mgKOH/g. The trifunctional polyol is preferably polycaprolactone polyol, and the tetrafunctional polyol is preferably polyoxyethylene diglyceryl ether. When these materials are used, the storage modulus and the storage modulus ratios of the polishing layer can be easily controlled within the desired ranges. If the hydroxyl value is less than 150 mgKOH/g, the polyurethane may have a low hard segment content so that its durability may tend to be low. If the hydroxyl value is more than 400 gmKOH/g, the degree of cross-linkage of the polyurethane foam may be too high so that it may tend to be brittle.

The content of the trifunctional polyol and/or tetrafunctional polyol in all active hydrogen-containing compounds is preferably from 35 to 90% by weight (which is the total content when they are both used), more preferably from 40 to 75% by weight, in particular, preferably from 45 to 65% by weight. When these materials are used in such specific amounts, the storage modulus and the storage modulus ratios of the polishing layer can be easily controlled in the desired ranges.

A bifunctional polyol with a hydroxyl value of 30 to 150 mgKOH/g is preferably used in combination with the trifunctional polyol and/or the tetrafunctional polyol. The bifunctional polyol more preferably has a hydroxyl value of 30 to 120 mgKOH/g. The bifunctional polyol is preferably polycaprolactone diol or polytetramethylene ether glycol. When these materials are used together, the storage modulus and the storage modulus ratios of the polishing layer can be more easily controlled within the desired ranges.

The content of the bifunctional polyol in all active hydrogen-containing compounds is preferably from 10 to 50% by weight, more preferably from 15 to 35% by weight. When this material is used in such a specific amount, the storage modulus and the storage modulus ratios of the polishing layer can be more easily controlled within the desired ranges.

Examples of the low-molecular-weight polyol that can be used together with a high-molecular-weight polyol described above include: ethylene glycol, 1,2-propylene glycol, 1,3-propylene glycol, 1,2-butanediol, 1,3-butanediol, 1,4-butanediol, 2,3-butanediol, 1,6-hexanediol, neopentyl glycol, 1,4-cyclohexanedimethanol, 3-methyl-1,5-pentanediol, diethylene glycol, triethyleneglycol, 1,4-bis(2-hydroxyethoxy)benzene, trimethylolpropane, glycerin, 1,2,6-hexanetriol, pentaerythritol, tetramethylolcyclohexane, methyl glucoside, sorbitol, mannitol, dulcitol, sucrose, 2,2,6,6-tetrakis(hydroxymethyl)cyclohexanol, diethanolamine, N-methyldiethanolamine, triethanolamine and the like. Other examples that can be used together with the high-molecular-weight polyol also include: low-molecular-weight polyamine such as ethylenediamine, tolylenediamine, diphenylmethanediamine, diethylenetriamine and the like. Still other examples that can be used together with the high-molecular-weight polyol also include: alcoholamines such as monoethanolamine, 2-(2-aminoethylamino)ethanol, monopropanolamine and the like. These low-molecular-weight polyols, high-molecular-weight polyamines etc. may be used alone or as a mixture of two or more thereof.

Among these compounds, a low-molecular-weight polyol having a hydroxyl value of 400 to 1830 mg KOH/g and/or a low-molecular-weight polyamine having an amine value of 400 to 1870 mg KOH/g are preferably used. The hydroxyl value is more preferably 900 to 1500 mg KOH/g, and the amine value is more preferably 400 to 950 mg KOH/g. When the hydroxyl value is less than 400 mg KOH/g or the amine value is less than 400 mg KOH/g, an effect of improving formation of interconnected cells tends to be not sufficiently obtained. On the other hand, when the hydroxyl value is greater than 1830 mg KOH/g or the amine value is greater than 1870 mg KOH/g, a wafer tends to be easily scratched on the surface. Particularly, diethylene glycol, 1,2-propylene glycol, 1,3-butanediol, 1,4-butanediol, or trimethylolpropane is preferably used.

The low-molecular-weight polyol, the low-molecular-weight polyamine and the alcohol amine are contained in the total amount of preferably 5 to 20 wt %, more preferably 5 to 15 wt %, in the active hydrogen-containing compound. By using the low-molecular-weight polyol etc. in specified amounts, cell films are easily broken to easily form an interconnected cell structure and further the mechanical characteristics of the polyurethane foam are improved.

In the case where a polyurethane foam is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5'-tetraethyldiphenylmethane, 4,4'-diamino-3,3'-diisopropyl-5.5'-dimethyldiphenylmethane, 4,4'-diamino-3,3',5,5'-tetraisopropyldiphenylmethane, 1,2-bis(2-aminophenylthio) ethane, 4,4'-diamino-3,3'-diethyl-5.5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyol component; and a low-molecular-weight polyamine component. The chain extenders described above may be used either alone or in mixture of two kinds or more.

A ratio between an isocyanate component and an active hydrogen-containing compound in the invention can be altered in various ways according to molecular weights thereof, desired physical properties of polyurethane foam and the like. In order to obtain polyurethane foam with desired polishing characteristics, a ratio of the number of isocyanate groups in an isocyanate component relative to a total number of active hydrogen groups (hydroxyl groups+amino groups) in an active hydrogen-containing compound is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

A polyurethane resin can be produced by applying a melting method, a solution method or a known polymerization technique, among which preferable is a melting method, consideration being given to a cost, a working environment and the like.

Manufacture of a polyurethane resin is enabled by means of either a prepolymer method or a one shot method.

Production of the polyurethane resin is to mix a first component containing the isocyanate-containing compound and a second component containing the active hydrogen-containing compound, and cure the mixture. In the prepolymer method, the isocyanate-terminal prepolymer is the isocyanate-containing compound, and a chain extender is the active hydrogen-containing compound. In the one shot method, the isocyanate component is the isocyanate-containing compound, and the chain extender and the polyol component is the active hydrogen-containing compound.

The polyurethane foam as the material for forming the polishing layer is produced by a mechanical foaming method (including a mechanical frothing method) using a silicone-based surfactant.

Particularly, a mechanical foaming method using a silicone-based surfactant which is a copolymer of polyalkylsiloxane and polyether is preferable. As such the silicone-based surfactant, SH-192 and L-5340 (manufactured by Toray Dow Corning Silicone Co., Ltd.), B8443 and B8465 (manufactured by Goldschmidt Ltd.) etc. are exemplified as a suitable compound.

The silicone-based surfactant is added to the polyurethane foam at preferably 0.1 to 10% by weight, more preferably 0.5 to 5% by weight.

Various additives may be mixed; such as a stabilizer including an antioxidant, a lubricant, a pigment, a filler, an antistatic agent and others.

Description will be given of an example of a method of producing a polyurethane foam constituting a polishing layer below. A method of manufacturing such a polyurethane foam has the following steps.

(1) The first component wherein a silicon-based surfactant is added to an isocyanate-terminated prepolymer produced by an isocyanate component with a high-molecular-weight polyol or the like is mechanically stirred in the presence of an unreactive gas, to disperse the unreactive gas as fine cells thereby forming a cell dispersion. Then, the second component containing chain extender are added to, and mixed with, the cell dispersion to prepare a cell dispersed urethane composition. If necessary, a catalyst may be added to the second component.

(2) A silicon-based surfactant is added to the first component containing an isocyanate component (or an isocyanate-terminated prepolymer) and/or the second component containing active hydrogen-containing compounds, and the component(s) to which the silicon-based surfactant is added is mechanically stirred in the presence of an unreactive gas, to disperse the unreactive gas as fine cells thereby forming a cell dispersion. Then, the remaining component is added to, and mixed with, the cell dispersion to prepare a cell dispersed urethane composition.

(3) A silicon-based surfactant is added to at least either of the first component containing an isocyanate component (or an isocyanate-terminated prepolymer) or the second component containing active hydrogen-containing compounds, and the first and second components are mechanically stirred in the presence of an unreactive gas, to disperse the unreactive gas as fine cells thereby preparing a cell dispersed urethane composition.

Alternatively, the cell dispersed urethane composition may be prepared by a mechanical frothing method. The mechanical frothing method is a method wherein starting components are introduced into a mixing chamber, while an unreactive gas is mixed therein, and the mixture is mixed under stirring with a mixer such as an Oaks mixer thereby dispersing the unreactive gas in a fine-cell state in the starting mixture. The mechanical frothing method is a preferable method because a density of the polyurethane foam can be easily adjusted by regulating the amount of an unreactive gas mixed therein. In addition, the efficiency of production is high because the polyurethane foam having roughly spherical fine cells can be continuously formed.

The unreactive gas used for forming fine bubbles is preferably not combustible, and is specifically nitrogen, oxygen, a carbon dioxide gas, a rare gas such as helium and argon, and a mixed gas thereof, and the air dried to remove water is most preferable in respect of cost.

As a stirring device for dispersing an unreactive gas in a fine-cell state, any known stirring deices can be used without particular limitation, and specific examples include a homogenizer, a dissolver, a twin-screw planetary mixer, a mechanical froth foaming machine etc. The shape of a stirring blade of the stirring device is not particularly limited, and a whipper-type stirring blade is preferably used to form fine cells. For obtaining the intended polyurethane foam, the number of revolutions of the stirring blade is preferably 500 to 2000 rpm, more preferably 800 to 1500 rpm. The stirring time is suitably regulated depending on the intended density.

In a preferable mode, different stirring devices are used for preparing a cell dispersion in the foaming process and for stirring the first and the second components to mix them, respectively. Stirring in the mixing step may not be stirring for forming cells, and a stirring device not generating large cells is preferably used in the mixing step. Such a stirring device is preferably a planetary mixer. The same stirring device may be used in the foaming step of preparing a cell dispersion and in the mixing step of mixing the respective components, and stirring conditions such as a revolution rate of the stirring blade are preferably regulated according to necessary.

The cell dispersed urethane composition prepared by the method described above is applied onto a base material layer, and the cell dispersed urethane composition is cured to form a polyurethane foam (polishing layer) directly on the base material layer.

The base material layer is not particularly limited, and examples include a plastic film such as polypropylene, polyethylene, polyester and polyvinyl chloride, a polymer resin foam such as polyurethane foam and polyethylene foam, rubber-like resin such as butadiene rubber and isoprene rubber, and photosensitive resin. Among these materials, a plastic film such as polypropylene, polyethylene, polyester, polyamide and polyvinyl chloride and a polymer resin foam such as polyurethane foam and polyethylene foam are preferably used. A double-sided tape, or a single-sided pressure-sensitive adhesive tape (a pressure-sensitive adhesive layer on one side is stuck to a platen), may be used as the base material layer.

The base material layer preferably has hardness equal to or higher than that of the polyurethane foam in order to confer toughness on the polishing pad. The thickness of the base material layer (or the thickness of the base material in the case of a double-sided tape and a single-sided pressure-sensitive adhesive tape) is not particularly limited, but is preferably 20 to 1000 μm, more preferably 50 to 800 μm from the viewpoint of strength and flexibility.

A method of applying the cell dispersed urethane composition onto a base material layer can make use of coating methods using, for example, roll coaters such as a gravure coater, kiss-roll coater and comma coater, die coaters such as a slot coater and fountain coater, and a squeeze coater, a curtain coater etc., and any methods can be used insofar as a uniform coating film can be formed on a base material layer.

Post curing by heating the polyurethane foam formed by applying the cell dispersed urethane composition onto a base material layer and then reacting the composition until it does not flow has an effect of improving the physical properties of the polyurethane foam and is thus extremely preferable. Post curing is carried out preferably at 30 to 80° C. for 10 minutes to 6 hours and conducted preferably at normal pressures in order to stabilize the shape of cells.

In the production of the polyurethane foam, known catalysts promoting a polyurethane reaction, such as tertiary amine-based catalysts, may be used. The type and amount of the catalyst added are determined in consideration of flow time for application onto a base material layer after the step of mixing the respective components.

Production of the polyurethane foam may be carried out in a batch system wherein the respective components are weighed, introduced into a container, and mechanically stirred, or in a continuous production system wherein the respective components and an unreactive gas are continuously fed to a stirring device and mechanically stirred, and the resulting cell dispersed urethane composition is sent onto a base material layer to form a product.

In addition, it is preferable to uniformly adjust the thickness of the polyurethane foam after formation of the polyurethane foam on the base material layer or simultaneously with formation of the polyurethane foam. A method of uniformly adjusting the thickness of the polyurethane foam is not particularly limited, but examples include a method of buffing with a polishing material, and a method of pressing a pressing plate.

In addition, the cell dispersed urethane composition prepared by the method described above is applied onto a base material layer, and a release sheet is laminated on the cell dispersed urethane composition. Thereafter, the cell dispersed urethane composition may be cured to form a polyurethane foam while the thickness thereof is made uniform with a pressing means. The method is a particularly preferable method because the thickness of the polishing layer can be regulated extremely uniformly.

On the other hand, the cell dispersed urethane composition prepared by the method described above is applied onto a release sheet, and a base material layer is laminated on the cell dispersed urethane composition. Thereafter, the cell dispersed urethane composition may be cured to form a polyurethane foam while the thickness thereof is made uniform with a pressing means. The method is a particularly preferable method because the thickness of the polishing layer can be regulated extremely uniformly.

A material for forming the release sheet is not particularly limited, and can include an ordinary resin and paper. The release sheet is preferably a sheet of less dimensional change upon heating. The surface of the release sheet may have been subjected to release treatment.

A pressing means for pressing a sandwich sheet made of the base material layer, the cell dispersed urethane composition (cell dispersed urethane layer) and the release sheet to make the thickness of the sandwich sheet uniform is not particularly limited, and for example, a method of pressing it to a predetermined thickness with a coater roll, a nip roll or the like. In considering the fact that, after compression, the size of cells in the foam is increased about 1.2 to 2 times, it is preferable in compression to satisfy the following equation: (Clearance of a coater or nip)−(thickness of the base material layer and release sheet)=(50 to 85% of the thickness of the polyurethane foam after curing).

After the thickness of the sandwich sheet is made uniform, the polyurethane foam is reacted until it does not flow, followed post cure. The conditions for post cure are the same as described above.

Thereafter, a release sheet on an upper surface side or a lower surface side of the polyurethane foam is separated to obtain a polishing pad. In this case, since a skin layer is formed on the polyurethane foam, the skin layer is removed by buffing, and the like. In addition, when the polyurethane foam is formed by a mechanical foaming method as described above, variation of the cells is smaller on a lower surface side than on an upper surface side of the polyurethane foam. Therefore, when a release sheet on a lower surface side is separated, and a lower surface side of the polyurethane foam is used as a polishing surface, since a polishing surface having small variation of the cells is obtained, stability of the polishing rate is more improved.

In addition, after the polishing layer is formed without forming the polyurethane foam (polishing layer) directly on the base material layer, the foam may be applied to the base material layer using a double-sided tape, and the like.

In an embodiment of the invention, the polishing layer is characterized by having a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

In an embodiment of the invention, the polishing layer having the above physical properties allows high-precision control of its thickness (during slicing).

The shape of the polishing pad of the present invention is not particularly limited, but may be a long shape of around a few meters in length, or may be a round shape of a diameter of a few tens centimeters.

The polishing layer formed by the above method has an interconnected cell structure, in which the interconnected cells essentially have an average cell diameter of 35 to 200 μm, preferably 40 to 100 μm.

The specific gravity of the polishing layer is preferably 0.2 to 0.7, more preferably 0.3 to 0.6. When the specific gravity is less than 0.2, the durability of polishing layer tends to be deteriorated. When the specific gravity is greater than 0.7, the crosslink density of the material should be lowered to attain a certain modulus of elasticity. In this case, permanent deformation tends to be increased and durability tends to be deteriorated.

The hardness of the polishing layer, as determined by an Asker C hardness meter, is preferably 10 to 95 degrees, more preferably 40 to 90 degrees. When the Asker C hardness is less than 10 degrees, the durability of the polishing layer is reduced, and the planarity of an object of polishing after polishing tends to be deteriorated. When the hardness is greater than 95 degrees, on the other hand, the surface of a material polished is easily scratched.

A polishing layer is preferably provided with a depression and a protrusion structure for holding and renewing a slurry. Though in a case where the polishing layer is formed with a fine foam, many openings are on a polishing surface thereof which works so as to hold the slurry, a depression and protrusion structure are preferably provided on the surface of the polishing side thereof in order to achieve more of holdability and renewal of the slurry or in order to prevent induction of dechuck error, breakage of a wafer or decrease in polishing efficiency. The shape of the depression and protrusion structure is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These depression and protrusion structure are generally those having regularity, but the groove pitch, groove width, groove depth etc. can also be changed at each certain region to make retention and renewal of slurry desirable.

The method of forming the depression and protrusion structure is not particularly limited, and for example, formation by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

The thickness of the polishing layer is not particularly limited, but is usually about 0.2 to 2 mm, preferably 0.5 to 1.5 mm.

A polishing pad of the invention may be provided with a double sided tape on the surface of the pad adhered to a platen.

No specific limitation is imposed on a polishing method of an object to be polished 4 (such as a semiconductor wafer, a lens, or a glass plate etc.) and a polishing apparatus, and polishing is performed with a polishing apparatus equipped, as shown in FIG. 1, with a polishing platen 2 supporting a polishing pad 1, a polishing head 5 holding an object to be polished 4, a backing material for applying a uniform pressure against the wafer and a supply mechanism of a polishing agent 3. The polishing pad 1 is mounted on the polishing platen 2 by adhering the pad to the platen with a double sided tape. The polishing platen 2 and the polishing head 5 are disposed so that the polishing pad 1 and the object to be polished 4 supported or held by them oppositely face each other and provided with respective rotary shafts 6 and 7. A pressure mechanism for pressing the object to be polished 4 to the polishing pad 1 is installed on the polishing head 5 side. During polishing, the object to be polished 4 is polished by being pressed against the polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

EXAMPLES

Description will be given of the invention with examples, while the invention is not limited to description in the examples.

[Measurement and Evaluation Method]

(Measurement of Average Cell Diameter)

The prepared polyurethane foam was cut parallel to a thickness of 1 mm or less with a razor blade as thin as possible to be used as a sample. The sample was fixed on a glass slide, and this was observed at magnification of 100 using SEM (S-3500N, Hitachi Science Systems Co., Ltd.). From the resulting image, the cell diameter of the whole continuous cells in the arbitrary range were measured using an image analyzing software (WinRoof, Mitani Corporation), and the average cell diameter were calculated. Provided that in the case of an ellipsoidal cell, the area thereof was converted into the area of a circle, and the circle-corresponding diameter was adopted as the cell diameter.

(Measurement of Specific Gravity)

Determined according to JIS Z8807-1976. The prepared polyurethane foam cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Hardness)

A hardness was measured in accordance with JIS K-7312. The prepared polyurethane foam was cut into samples with a size of 5 cm×5 cm (with arbitrary thickness), and the samples were left for 16 hours in an environment at a temperature of 23° C.±2° C. and humidity of 50%±5%. When measured, the samples were piled up to a thickness of 10 mm or more. A hardness meter (Asker C hardness meter, pressurized surface height 3 mm, manufactured by Kobunshi Keiki Co., Ltd.) was contacted with a pressurized surface, and 60 seconds later, the hardness was measured.

(Measurement of Storage Modulus)

A dynamic viscoelasticity meter (DMA861e manufactured by Mettler-Toledo International Inc.) was used to measure the storage modulus E' (30° C.) at 30° C., the storage modulus E' (40° C.) at 40° C., the storage modulus E' (60° C.) at 60° C., the storage modulus E' (90° C.) at 90° C. of the polishing layer under the conditions below.

Frequency: 1.6 Hz

Rate of temperature rise: 2.0° C./minute

Measurement temperature range: 0-120° C.

Sample shape: 19.5 mm long, 3.0 mm wide, 1.0 mm thick (Measurement of Thickness Variation)

The prepared polyurethane foam was cut into a sample piece with a size of 50 cm×50 cm. Horizontal and vertical straight lines were drawn on the sample at intervals of 5 cm, and the thickness was measured at the intersections using a micrometer (CLM1-15QM manufactured by Mitutoyo Corporation). The thickness variation was defined as the difference between the maximum and minimum measurements.

(Measurement of Average Polishing Rate)

The rate of polishing with the prepared polishing pad was measured using a polishing apparatus (Model 9B-5P-V manufactured by SPEEDFAM CO., LTD.). The polishing conditions were as follows.

Glass plate: 6 inches f, 1.1 mm thick (optical glass, BK7)

Slurry: Ceria slurry (GPL C1010, SHOWA DENKO K.K.)

Slurry rate: 4,000 ml/minute

Polishing pressure: 100 g/cm$^2$

Number of revolutions of polishing platen: 30 rpm

Carrier: Normal rotation

Dresser: Dresser with #400 diamond pellets

Polishing time: 10 minute/piece

Number of glass plates polished: 100 pieces

The polishing rate (Å/minute) was calculated from the formula below for each one piece of the glass plate polished, and the average polishing rate (Å/minute) was calculated for the 100 glass plates.

Polishing rate=[the change (g) in the weight of the glass plate before and after polishing/(the density (g/cm$^3$) of the glass plate×the polished area (cm$^2$) of the glass plate×polishing time (minute))]×10$^8$ (Measurement of Break-In Time)

The polishing rate was determined for each 5 minute dressing by the above method, and the break-in time was defined as the time required to reach the same polishing rate as that reached by 240 minute dressing.

Example 1

To a vessel were added 55 parts by weight of polycaprolactone triol (PCL305 manufactured by DAICEL CHEMICAL INDUSTRIES, LTD., 3 in the number of functional groups, 305 mgKOH/g in hydroxyl value), 30 parts by weight of polytetramethylene ether glycol (PTMG 1000 manufactured by Mitsubishi Chemical Corporation, 2 in the number of functional groups, 112 mgKOH/g in hydroxyl value), 13 parts by weight of diethylene glycol (DEG, 2 in the number of functional groups, 1,058 mgKOH/g in hydroxyl value), 2 parts by weight of trimethylolpropane (TMP, 3 in the number of functional groups, 1,255 mgKOH/g in hydroxyl value), 6 parts by weight of a silicone surfactant (B8443 manufactured by Goldschmidt A. G.), and 0.03 parts by weight of a catalyst (Kao No. 25 manufactured by Kao Corporation) and mixed. The reaction system was vigorously stirred for about 4 minutes with a stirring blade at a rotational speed of 900 rpm so that air cells were incorporated into the reaction system. Thereafter, 103 parts by weight of MILLIONATE MTL (manufactured by NIPPON POLYURETHANE INDUSTRY CO., LTD.) was added, and the mixture was stirred for about 1 minute to give a cell dispersed urethane composition.

The prepared cell dispersed urethane composition was applied to a release sheet (polyethylene terephthalate, 0.1 mm in thickness, manufactured by TOYOBO CO., LTD.) which had undergone a release treatment, so that a cell dispersed urethane layer was formed on the sheet. The cell dispersed urethane layer was then covered with a base material layer (polyethylene terephthalate, 0.2 mm in thickness). The cell dispersed urethane layer was pressed into a thickness of 1.2 mm with nip rollers and then cured at 70° C. for 3 hours, so that a polyurethane foam (with an interconnected cell structure) was formed. The release sheet was then peeled off from the polyurethane foam. Using a hand saw-type slicer (manufactured by Fecken-Kirfel GmbH & Co.), the surface of the polyurethane foam was sliced, so that its thickness was reduced to 1.0 mm and the thickness precision was controlled. Subsequently, a double-sided adhesive tape (DOUBLE TACK TAPE manufactured by SEKISUI CHEMICAL CO. LTD.) was bonded to the surface of the base material layer using a laminator, so that a polishing pad was obtained.

Examples 2 to 12 and Comparative Examples 1 to 11

Polishing pads were prepared using the compositions shown in Tables 1 and 2 by the same method as that in Example 1. The compounds shown in Tables 1 and 2 are as follows:

PTMG3000 (polytetramethylene ether glycol, manufactured by Mitsubishi Chemical Corporation, 2 in the number of functional groups, 37 mgKOH/g in hydroxyl value)

PCL205 (polycaprolactone diol, manufactured by DAICEL CHEMICAL INDUSTRIES, LTD., 2 in the number of functional groups, 212 mgKOH/g in hydroxyl value)

MOCA (4,4'-methylenebis(o-chloroaniline), 2 in the number of functional groups, 419 mgKOH/g in amine value) 1,4-BG (1,4-butanediol, 2 in the number of functional groups, 1,245 mgKOH/g in hydroxyl value)

1,2-PG (1,2-propylene glycol, 2 in the number of functional groups, 1,477 mgKOH/g in hydroxyl value)

PCL312 (polycaprolactone triol, manufactured by DAICEL CHEMICAL INDUSTRIES, LTD., 3 in the number of functional groups, 134 mgKOH/g in hydroxyl value)

PCL308 (polycaprolactone triol, manufactured by DAICEL CHEMICAL INDUSTRIES, LTD., 3 in the number of functional groups, 198 mgKOH/g in hydroxyl value)

SC-E1000 (polyoxyethylene diglyceryl ether, manufactured by Sakamoto Yakuhin Kogyo Co., Ltd., 4 in the number of functional groups, 224 mgKOH/g in hydroxyl value)

PCL303 (polycaprolactone triol, manufactured by DAICEL CHEMICAL INDUSTRIES, LTD., 3 in the number of functional groups, 560 mgKOH/g in hydroxyl value)

EX-890MP (propylene oxide adduct of trimethylolpropane, manufactured by Asahi Glass Company, 3 in the number of functional groups, 865 mgKOH/g in hydroxyl value)

EX551DE (filler, manufactured by Japan Fillite co., ltd.)

L-325 (polyether prepolymer, ADIPRENE L-325, manufactured by Uniroyal Chemical Company Inc.)

TABLE 1

| | | Number of functional groups | Hydroxyl or amine value | Example 1 | Example 2 | Example 3 | Example 4 | Example 5 | Example 6 |
|---|---|---|---|---|---|---|---|---|---|
| R liquid | PTMG3000 | 2 | 37 | | | | | | |
| | PTMG1000 | 2 | 112 | 30 | 30 | 30 | 30 | 30 | 15 |
| | PCL205 | 2 | 212 | | | | | | |
| | MOCA | 2 | 419 | | | | | | |
| | DEG | 2 | 1058 | 13 | | | 13 | | |
| | 1,4-BG | 2 | 1245 | | 13 | | | | |
| | 1,2-PG | 2 | 1477 | | | 13 | | 13 | |
| | PCL312 | 3 | 134 | | | | | | |
| | PCL308 | 3 | 198 | | | | 55 | 55 | |
| | PCL305 | 3 | 305 | 55 | 55 | 55 | | | 85 |
| | SC-E1000 | 4 | 224 | | | | | | |
| | PCL303 | 3 | 560 | | | | | | |
| | EX-890MP | 3 | 865 | | | | | | |
| | TMP | 3 | 1255 | 2 | 2 | 2 | 2 | 2 | |
| | Content (wt %) of trifunctional or tetrafunctional polyol with hydroxyl value of 150 to 400 | | | 55 | 55 | 55 | 55 | 55 | 85 |
| | Content (wt %) of bifunctional polyol with hydroxyl value of 30 to 150 | | | 30 | 30 | 30 | 30 | 30 | 15 |
| Foam stabilizer | B8443 | | | 6 | 6 | 6 | 6 | 6 | 6 |
| Filler | EX551DE | | | | | | | | |
| Catalyst | Kao No. 25 | | | 0.03 | 0.03 | 0.07 | 0.05 | 0.10 | 0.02 |
| P liquid | MILLIONATE MTL | | | 103 | 110 | 118 | 86 | 102 | 78 |
| | L-325 | | | | | | | | |
| Physical properties | Average cell diameter (μm) | | | 62 | 68 | 66 | 80 | 84 | 68 |
| | Specific gravity | | | 0.493 | 0.496 | 0.481 | 0.441 | 0.465 | 0.463 |
| | C hardness | | | 88 | 90 | 80 | 77 | 74 | 92 |
| | E' (30° C.) (MPa) | | | 232 | 256 | 210 | 194 | 185 | 265 |
| | E' (40° C.) (MPa) | | | 217 | 243 | 198 | 180 | 169 | 250 |
| | E' (60° C.) (MPa) | | | 116 | 127 | 117 | 81 | 88 | 170 |
| | E' (90° C.) (MPa) | | | 2 | 3 | 4 | 2 | 3 | 10 |
| | E' (30° C.)/E' (60° C.) | | | 2.0 | 2.0 | 1.8 | 2.4 | 2.1 | 1.6 |
| | E' (30° C.)/E' (90° C.) | | | 109 | 77 | 48 | 121 | 68 | 30 |
| Characteristics | Thickness variation (μm) | | | 73 | 85 | 64 | 70 | 75 | 84 |
| | Average polishing rate (Å/min) | | | 5750 | 5920 | 6150 | 5640 | 5980 | 6170 |
| | Break-in time (min) | | | 20 | 30 | 20 | 20 | 30 | 30 |

| | | Number of functional groups | Hydroxyl or amine value | Example 7 | Example 8 | Example 9 | Example 10 | Example 11 | Example 12 |
|---|---|---|---|---|---|---|---|---|---|
| R liquid | PTMG3000 | 2 | 37 | 15 | | | | 45 | 15 |
| | PTMG1000 | 2 | 112 | | 30 | 15 | 45 | | |
| | PCL205 | 2 | 212 | | | | | | |
| | MOCA | 2 | 419 | | | | | | |
| | DEG | 2 | 1058 | | 15 | 10 | | 13 | 10 |
| | 1,4-BG | 2 | 1245 | | | | | | |
| | 1,2-PG | 2 | 1477 | | | | | | |
| | PCL312 | 3 | 134 | | | | | | |
| | PCL308 | 3 | 198 | | | | | | 75 |
| | PCL305 | 3 | 305 | 85 | | 75 | 55 | 40 | |
| | SC-E1000 | 4 | 224 | | 55 | | | | |
| | PCL303 | 3 | 560 | | | | | | |
| | EX-890MP | 3 | 865 | | | | | 2 | |
| | TMP | 3 | 1255 | | | | | | |
| | Content (wt %) of trifunctional or tetrafunctional polyol with hydroxyl value of 150 to 400 | | | 85 | 55 | 75 | 55 | 40 | 75 |
| | Content (wt %) of bifunctional polyol with hydroxyl value of 30 to 150 | | | 15 | 30 | 15 | 45 | 45 | 15 |
| Foam stabilizer | B8443 | | | 6 | 6 | 6 | 6 | 6 | 6 |
| Filler | EX551DE | | | | | | | | |
| Catalyst | Kao No. 25 | | | 0.05 | 0.05 | 0.02 | 0.05 | 0.03 | 0.02 |
| P liquid | MILLIONATE MTL | | | 75 | 119 | 100 | 62 | 83 | 72 |
| | L-325 | | | | | | | | |
| Physical properties | Average cell diameter (μm) | | | 76 | 72 | 77 | 77 | 67 | 78 |
| | Specific gravity | | | 0.498 | 0.451 | 0.457 | 0.445 | 0.488 | 0.466 |
| | C hardness | | | 87 | 86 | 91 | 69 | 88 | 83 |
| | E' (30° C.) (MPa) | | | 220 | 202 | 360 | 180 | 145 | 205 |
| | E' (40° C.) (MPa) | | | 201 | 190 | 352 | 162 | 135 | 191 |
| | E' (60° C.) (MPa) | | | 129 | 150 | 198 | 82 | 120 | 108 |

TABLE 1-continued

| | | | | | | | |
|---|---|---|---|---|---|---|---|
| | E' (90° C.) (MPa) | 4 | 1.7 | 15 | 4 | 5 | 3 |
| | E' (30° C.)/E' (60° C.) | 1.7 | 1.3 | 1.8 | 2.2 | 1.2 | 1.9 |
| | E' (30° C.)/E' (90° C.) | 59 | 119 | 24 | 45 | 29 | 68 |
| Characteristics | Thickness variation (μm) | 71 | 75 | 84 | 76 | 86 | 87 |
| | Average polishing rate (Å/min) | 5760 | 5740 | 5910 | 5700 | 5850 | 5770 |
| | Break-in time (min) | 20 | 30 | 30 | 30 | 30 | 30 |

TABLE 2

| | | Number of functional groups | Hydroxyl or amine value | Comparative Example 1 | Comparative Example 2 | Comparative Example 3 | Comparative Example 4 | Comparative Example 5 | Comparative Example 6 |
|---|---|---|---|---|---|---|---|---|---|
| R liquid | PTMG3000 | 2 | 37 | | 60 | | | | |
| | PTMG1000 | 2 | 112 | | | | 15 | 30 | |
| | PCL205 | 2 | 212 | | | 65 | | | 55 |
| | MOCA | 2 | 419 | 26.5 | | | | | |
| | DEG | 2 | 1058 | | 13 | 13 | | 13 | 13 |
| | 1,4-BG | 2 | 1245 | | | | | | |
| | 1,2-PG | 2 | 1477 | | | | | | |
| | PCL312 | 3 | 134 | | | | 85 | | 30 |
| | PCL308 | 3 | 198 | | | | | | |
| | PCL305 | 3 | 305 | | 25 | 20 | | | |
| | SC-E1000 | 4 | 224 | | | | | | |
| | PCL303 | 3 | 560 | | | | | | |
| | EX-890MP | 3 | 865 | | 2 | 2 | | 55 | 2 |
| | TMP | 3 | 1255 | | | | | 2 | |
| | Content (wt %) of trifunctional or tetrafunctional polyol with hydroxyl value of 150 to 400 | | | 0 | 25 | 20 | 0 | 0 | 0 |
| | Content (wt %) of bifunctional polyol with hydroxyl value of 30 to 150 | | | 0 | 60 | 0 | 15 | 30 | 0 |
| Foam stabilizer | B8443 | | | 6 | 6 | 6 | 6 | 6 | 6 |
| Filler | EX551DE | | | 2.1 | | | | | |
| Catalyst | Kao No. 25 | | | | 0.07 | 0.03 | 0.03 | 0.02 | 0.03 |
| P liquid | MILLIONATE MTL | | | | 79 | 100 | 37 | 191 | 89 |
| | L-325 | | | 100 | | | | | |
| Physical properties | Average cell diameter (μm) | | | 50 | 81 | 75 | 81 | 74 | 77 |
| | Specific gravity | | | 0.810 | 0.495 | 0.498 | 0.497 | 0.371 | 0.493 |
| | C hardness | | | 94 | 79 | 85 | 61 | 96 | 66 |
| | E' (30° C.) (MPa) | | | 348 | 67 | 245 | 135 | 474 | 152 |
| | E' (40° C.) (MPa) | | | 297 | 56 | 210 | 121 | 468 | 139 |
| | E' (60° C.) (MPa) | | | 206 | 32 | 90 | 17 | 365 | 38 |
| | E' (90° C.) (MPa) | | | 95 | 10 | 1.5 | 1 | 140 | 1 |
| | E' (30° C.)/E' (60° C.) | | | 1.7 | 2.1 | 2.7 | 7.8 | 1.3 | 4.0 |
| | E' (30° C.)/E' (90° C.) | | | 3.7 | 6.8 | 163 | 135 | 3 | 152 |
| Characteristics | Thickness variation (μm) | | | 189 | 79 | 70 | 71 | 285 | 72 |
| | Average polishing rate (Å/min) | | | 5310 | 4950 | 4500 | 4030 | 5890 | 4160 |
| | Break-in time (min) | | | 120 | 70 | 90 | 60 | 210 | 70 |

| | | Number of functional groups | Hydroxyl or amine value | Comparative Example 7 | Comparative Example 8 | Comparative Example 9 | Comparative Example 10 | Comparative Example 11 |
|---|---|---|---|---|---|---|---|---|
| R liquid | PTMG3000 | 2 | 37 | | | | 20 | |
| | PTMG1000 | 2 | 112 | | | 55 | | |
| | PCL205 | 2 | 212 | 40 | 15 | | | 55 |
| | MOCA | 2 | 419 | | | | | |
| | DEG | 2 | 1058 | 13 | | 5 | | 13 |
| | 1,4-BG | 2 | 1245 | | | | | |
| | 1,2-PG | 2 | 1477 | | | | | |
| | PCL312 | 3 | 134 | 45 | 85 | | | |
| | PCL308 | 3 | 198 | | | | | 30 |
| | PCL305 | 3 | 305 | | | 20 | 25 | |
| | SC-E1000 | 4 | 224 | | | | | |
| | PCL303 | 3 | 560 | | | 20 | 55 | |
| | EX-890MP | 3 | 865 | 2 | | | | 2 |
| | TMP | 3 | 1255 | | | | | |
| | Content (wt %) of trifunctional or tetrafunctional polyol with hydroxyl value of 150 to 400 | | | 0 | 0 | 20 | 25 | 30 |

TABLE 2-continued

| | | | | | | |
|---|---|---|---|---|---|---|
| | Content (wt %) of bifunctional polyol with hydroxyl value of 30 to 150 | 0 | 0 | 55 | 20 | 0 |
| Foam stabilizer | B8443 | 6 | 6 | 6 | 6 | 6 |
| Filler | EX551DE | | | | | |
| Catalyst | Kao No. 25 | 0.03 | 0.07 | 0.05 | 0.02 | 0.06 |
| P liquid | MILLIONATE MTL L-325 | 85 | 41 | 67 | 116 | 50 |
| Physical properties | Average cell diameter (μm) | 76 | 80 | 68 | 71 | 83 |
| | Specific gravity | 0.466 | 0.476 | 0.487 | 0.462 | 0.471 |
| | C hardness | 67 | 64 | 74 | 91 | 63 |
| | E' (30° C.) (MPa) | 144 | 152 | 193 | 254 | 168 |
| | E' (40° C.) (MPa) | 130 | 127 | 180 | 222 | 145 |
| | E' (60° C.) (MPa) | 36 | 25 | 69 | 72 | 60 |
| | E' (90° C.) (MPa) | 1 | 1 | 5 | 1 | 2 |
| | E' (30° C.)/E' (60° C.) | 4.0 | 6.1 | 2.8 | 3.5 | 2.8 |
| | E' (30° C.)/E' (90° C.) | 144 | 152 | 39 | 254 | 84 |
| Characteristics | Thickness variation (μm) | 73 | 76 | 70 | 118 | 70 |
| | Average polishing rate (Å/min) | 4200 | 4320 | 4220 | 4980 | 4010 |
| | Break-in time (min) | 70 | 80 | 70 | 60 | 90 |

DESCRIPTION OF REFERENCE CHARACTERS

In the drawing, reference numeral 1 represents a polishing pad, 2: a polishing platen, 3: a polishing agent (slurry), 4: an object to be polished (such as a semiconductor wafer, a lens, or a glass plate), 5: a support (polishing head), and 6 and 7: rotary shafts.

The invention claimed is:

1. A polishing pad, comprising a base material layer and a polishing layer provided on the base material layer, wherein the polishing layer comprises a thermoset polyurethane foam having roughly spherical interconnected hollow cells with an average cell diameter of 35 to 200 μm, and the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

2. The polishing pad according to claim 1, wherein the thermoset polyurethane foam is a product of reaction and curing of a urethane composition containing an isocyanate component and active hydrogen-containing compounds, wherein the active hydrogen-containing compounds comprise 35 to 90% by weight of a trifunctional polyol with a hydroxyl value of 150 to 400 mgKOH/g and/or a tetrafunctional polyol with a hydroxyl value of 150 to 400 mgKOH/g.

3. The polishing pad according to claim 2, wherein the active hydrogen-containing compounds further comprise 10 to 50% by weight of a bifunctional polyol with a hydroxyl value of 30 to 150 mgKOH/g.

4. The polishing pad according to claim 1, wherein the polishing layer is self-bonded to the base material layer.

5. The polishing pad according to claim 1, wherein the ratio of storage modulus E' (30° C.) at 30° C. to storage modulus E' (90° C.) at 90° C. [E'(30° C.)/E'(90° C.)] is 24 to 130.

6. A method for producing a polishing pad, comprising the steps of:

preparing, by a mechanical foaming method, a cell dispersed urethane composition which contains an isocyanate component, active hydrogen-containing compounds comprising 35 to 90% by weight of a trifunctional polyol with a hydroxyl value of 150 to 400 mgKOH/g and/or a tetrafunctional polyol with a hydroxyl value of 150 to 400 mgKOH/g, and a silicone surfactant;

applying the cell dispersed urethane composition to a base material layer;

curing the cell dispersed urethane composition to form a thermoset polyurethane foam having roughly spherical interconnected hollow cells with an average cell diameter of 35 to 200 μm; and uniformly controlling the thickness of the thermoset polyurethane foam to form a polishing layer, wherein the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

7. A method for producing a polishing pad, comprising the steps of:

preparing, by a mechanical foaming method, a cell dispersed urethane composition which contains an isocyanate component, active hydrogen-containing compounds comprising 35 to 90% by weight of a trifunctional polyol with a hydroxyl value of 150 to 400 mgKOH/g and/or a tetrafunctional polyol with a hydroxyl value of 150 to 400 mgKOH/g, and a silicone surfactant;

applying the cell dispersed urethane composition to a release sheet;

placing a base material layer on the cell dispersed urethane composition;

curing the cell dispersed urethane composition, while making a uniform thickness by pressing means, so that a thermoset polyurethane foam having roughly spherical interconnected hollow cells with an average cell diameter of 35 to 200 μm is formed;

peeling off the release sheet under the thermoset polyurethane foam; and removing a skin layer from an exposed surface of the thermoset polyurethane foam, wherein the polishing layer has a storage modulus E' (40° C.) of 130 to 400 MPa at 40° C., a ratio of storage modulus E' (30° C.) at 30° C. to storage modulus E' (60° C.) at 60° C. [E'(30° C.)/E'(60° C.)] of 1 to less than 2.5, and a ratio of storage modulus E' (30° C.) at 30° C. to storage modulus E' (90° C.) at 90° C. [E'(30° C.)/E'(90° C.)] of 15 to 130.

* * * * *